US011643827B2

(12) United States Patent
Pelletier et al.

(10) Patent No.: US 11,643,827 B2
(45) Date of Patent: May 9, 2023

(54) ASSEMBLY FOR IMPROVING PERFORMANCE AND LIFESPAN OF A CONCRETE FINISHING PAN

(71) Applicant: PLATE 2000 INC., St-Anselme (CA)

(72) Inventors: Stéphanie Pelletier, St-Anselme (CA); Al Khader Borki, Saint-Damien-de-Buckland (CA); Patrick Bolduc, St-Anselme (CA); Philippe Levasseur, Lévis (CA)

(73) Assignee: PLATE 2000 INC., St-Anselme (CA)

( * ) Notice: Subject to any disclaimer, the term of this patent is extended or adjusted under 35 U.S.C. 154(b) by 227 days.

(21) Appl. No.: 17/302,480

(22) Filed: May 4, 2021

(65) Prior Publication Data

US 2021/0348398 A1 Nov. 11, 2021

Related U.S. Application Data

(60) Provisional application No. 63/021,123, filed on May 7, 2020.

(51) Int. Cl.
*E04F 21/24* (2006.01)
*E01C 19/42* (2006.01)

(52) U.S. Cl.
CPC ..... *E04F 21/247* (2013.01); *E01C 19/42* (2013.01)

(58) Field of Classification Search
CPC ..... E04F 21/247; E01C 19/42
USPC ..... 404/112
See application file for complete search history.

(56) References Cited

U.S. PATENT DOCUMENTS

| | | | | |
|---|---|---|---|---|
| 6,857,815 | B2 | 2/2005 | Allen et al. | |
| 7,059,801 | B2 | 6/2006 | Snyder et al. | |
| 7,114,876 | B1 | 10/2006 | Allen et al. | |
| 7,674,068 | B2 * | 3/2010 | Valles | E04F 21/248 404/112 |
| 10,760,227 | B2 * | 9/2020 | Chapple | E01C 19/42 |
| 2009/0190999 | A1 * | 7/2009 | Copoulos | B24B 41/047 404/112 |
| 2010/0150653 | A1 * | 6/2010 | Jaszkowiak | E04F 21/247 404/112 |
| 2010/0202833 | A1 * | 8/2010 | Chapple | E04F 21/247 404/112 |
| 2010/0254763 | A1 * | 10/2010 | Grahl | E04F 21/247 404/112 |

(Continued)

FOREIGN PATENT DOCUMENTS

| | | | |
|---|---|---|---|
| WO | 2020249847 | A1 | 12/2020 |
| WO | 2021058862 | A1 | 4/2021 |

*Primary Examiner* — Raymond W Addie
(74) *Attorney, Agent, or Firm* — Lavery, De Billy, LLP; Gonzalo Lavin

(57) ABSTRACT

A reinforcement assembly removably connectable to a pan of a troweling machine having a rotor assembly with corresponding troweling arms each supporting a trowel blade is provided. The reinforcement assembly comprises a reinforcement member; a first connector connectable to the reinforcement member, the first connector being removably connectable to one of the troweling arms; and a second connector connectable to the reinforcement member, the second connector being removably connectable to the pan. In operation, the reinforcement assembly maximizes a distribution of weight of the troweling machine onto a surface of the pan.

17 Claims, 13 Drawing Sheets

(56) References Cited

U.S. PATENT DOCUMENTS

| | | | | |
|---|---|---|---|---|
| 2019/0211517 | A1 | 7/2019 | Howle et al. | |
| 2021/0047845 | A1* | 2/2021 | Guinn | E04F 21/247 |

* cited by examiner

ASSEMBLY FOR IMPROVING PERFORMANCE AND LIFESPAN OF A CONCRETE FINISHING PAN

CROSS-REFERENCE TO RELATED APPLICATIONS

This application claims benefit of U.S. patent application Ser. No. 63/021,123, filed on May 7, 2020, which is incorporated herein in its entirety by reference.

FIELD OF THE INVENTION

This invention relates generally to a powered concrete finishing apparatus and more specifically to a power trowel concrete finishing pan.

BACKGROUND OF THE INVENTION

Known versions of powered concrete finishing equipment often comprise a plurality of generally rectangular trowel blades rotating about a common axis and being in contact with the concrete.

Producing high-quality concrete floors is generally a multistep-process and starts after fresh concrete has been poured on the floor. It is common to use a motorized power trowel with adaptable pans, floats, plates or a combination of plates attached thereto. All these attachments are adapted to be used at different times during the working process.

To reach a high level of flatness, concrete finisher operators often perform their first passes on powered, motorized riding trowels with a pan, which is also called plate or finishing disc. The pan helps finishing a broader zone relative to the trowel blades alone by having a greater surface contacting the concrete. Also, the pan helps finish the concrete faster, which can have a positive impact on the work, hence concrete finisher operators work while the concrete is drying. Moved by trowels attached to a power trowel ride-on or walk-behind machine, the pans will typically wear, particularly where the weight of the machine mainly presses, under the trowels.

In view of the above, there is a need in the field for improving the lifespan of concrete finishing pans.

SUMMARY OF THE INVENTION

In order to address the above and other drawbacks, there is provided a reinforcement assembly removably connectable to a pan of a troweling machine having a rotor assembly with corresponding troweling arms each supporting a trowel blade, said reinforcement assembly comprising: a reinforcement member; a first connector operationally connectable to the reinforcement member, the first connector being removably and operationally connectable to one of the troweling arms or one of the trowel blades; and a second connector connectable to the reinforcement member, the second connector being removably and operationally connectable to the pan, wherein, in operation, the reinforcement assembly maximizes a distribution of weight of the troweling machine onto a surface of the pan.

In embodiments, the reinforcement assembly is dimensioned such that said pan can removably connect to two to height reinforcement assemblies simultaneously.

Advantageously, the reinforcement assembly prolongs the lifespan of concrete finishing pans by providing a larger contact area during the finishing phase between the surface of the pan and troweling machine. This reinforcement assembly provides another advantage resulting in a flatter pan that covers a larger surface and helps to finish concrete faster and flatter.

Other objects, advantages and features of the present invention will become more apparent upon reading of the following non-restrictive description of specific embodiments thereof, given by way of examples only with reference to the accompanying drawings.

DETAILED DESCRIPTION

The present invention is illustrated in further details by the following non-limiting examples.

Figure 1:
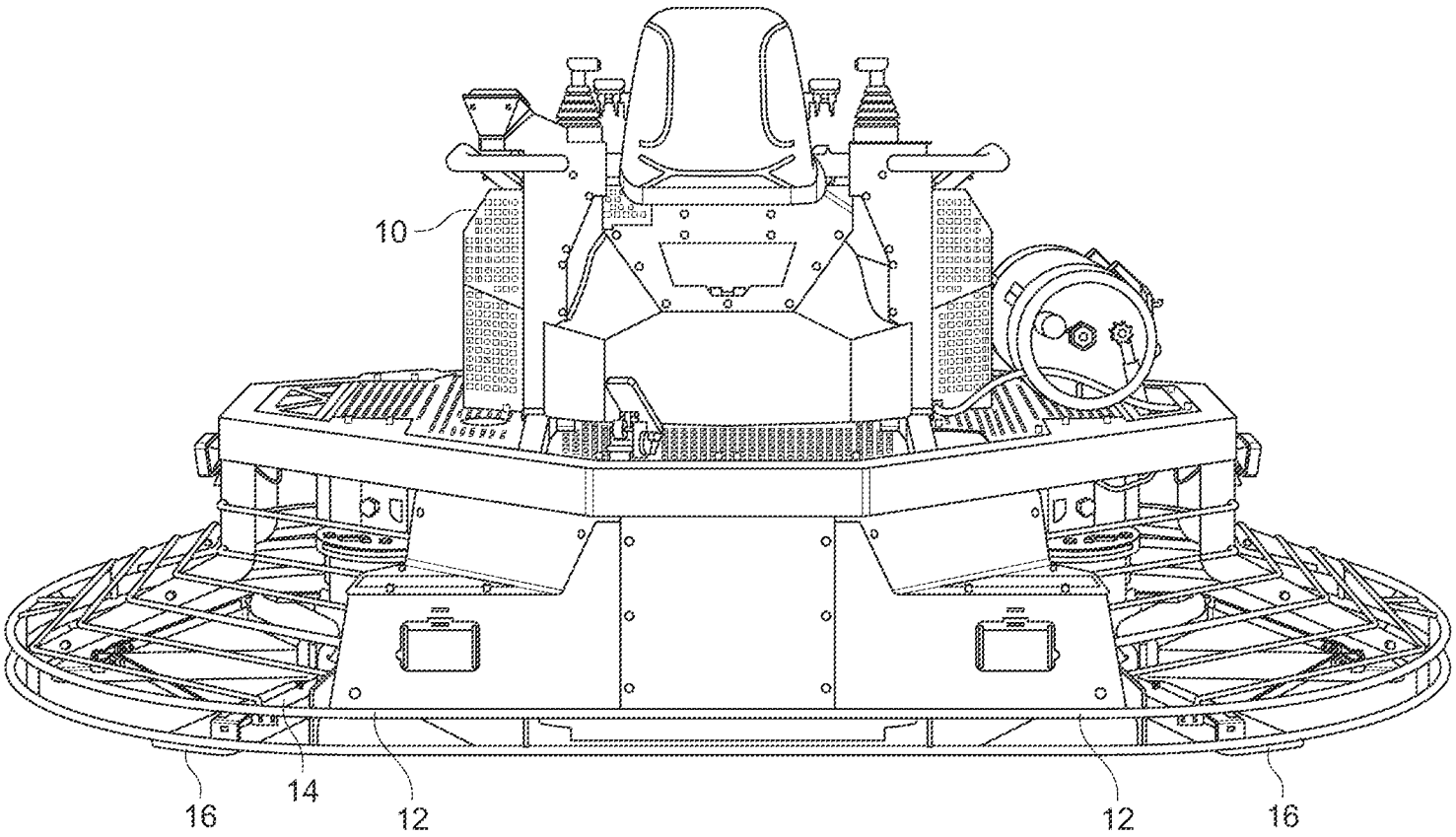
FIG. 1 PRIOR ART
FIG. 1 is a front view of known concrete finishing troweling machine.

Referring to FIG. 1, there is shown a known ride-on concrete finishing troweling machine 10. When used, an operator sits on top of the frame of the troweling machine 10 and controls operation of two motor-power rotor assemblies located at the bottom thereof. Typically, when pans are installed on the troweling machine 10 the pans will wear, particularly at the location where the weight of the machine mainly presses: under the trowel blades. The increase of the wear of the middle of the pan relative to the rest of the pan diminishes its lifetime of the pan. Such non-uniform wear of the pan is not desirable as it lowers the concrete finishing quality.

Figure 2:
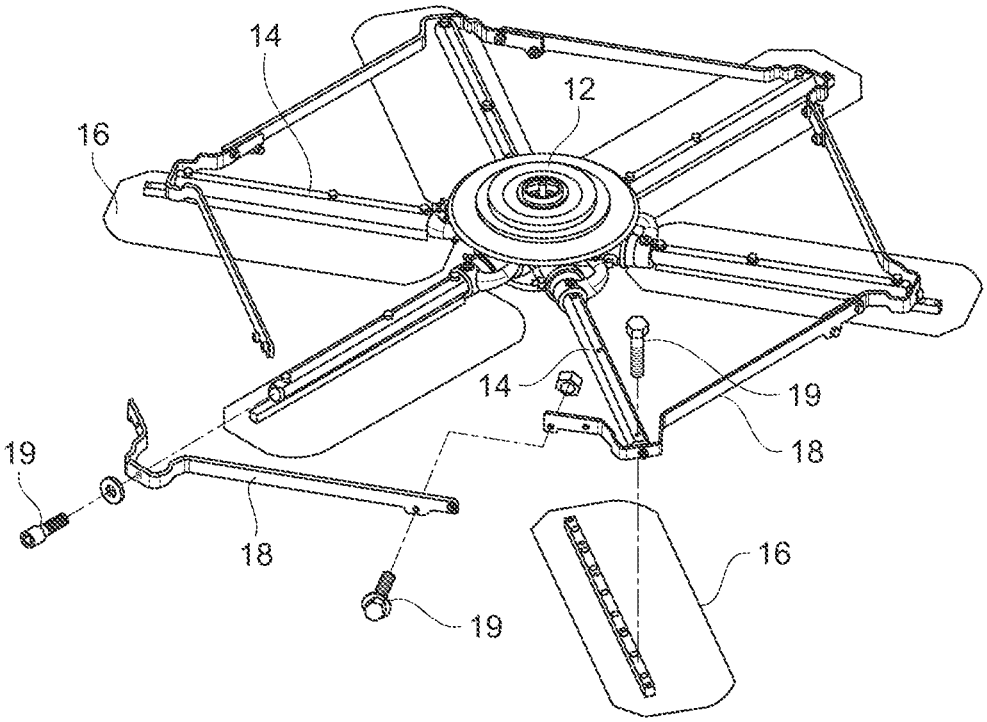
FIG. 2 PRIOR ART
FIG. 2 is a perspective view of a partly disassembled rotor assembly of the troweling machine shown in FIG. 1.

Referring now to FIG. 2, in addition to FIG. 1, there is shown a partly disassembled rotor assembly that may be used in the troweling machine 10. The rotor assembly includes a rotor 12 with a series of six troweling arms 14 supporting six corresponding troweling blades 16 for contacting and finishing the surface of the concrete. Struts and 18 and bolts 19 are shown, but normally a single ring is used instead of struts. The ring is attached at the end of the troweling arms 14. There is no need to remove the ring or struts to the install the reinforcement assemblies according to the present invention.

Figure 3:
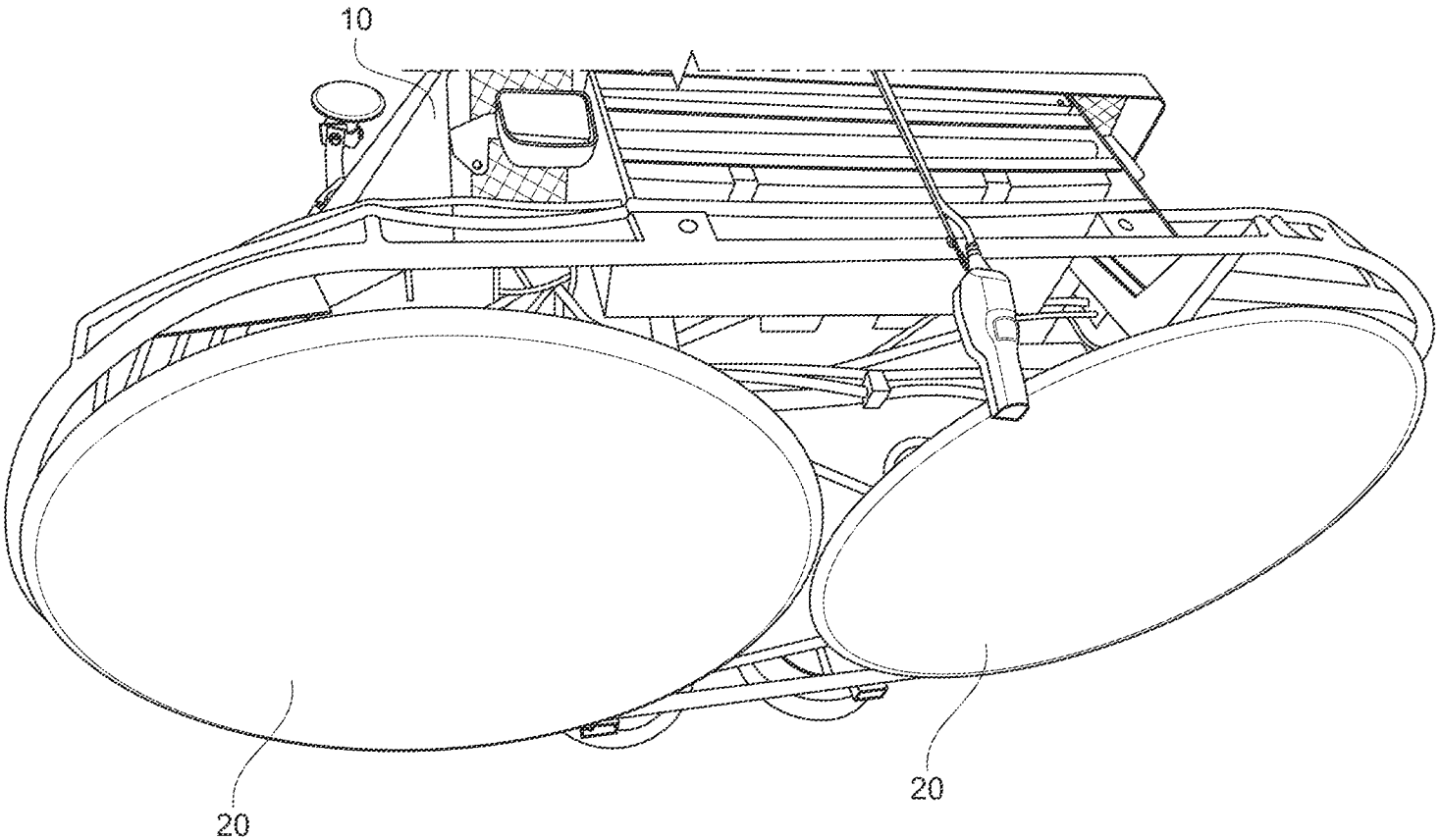
FIG. 3 is a bottom view of a pair of pans installed on the troweling machine of FIG. 1, according to an illustrative embodiment of the present invention.

Referring now to FIG. 3, in addition to FIGS. 1 and 2, there is shown the troweling machine 10 provided with two pans 20 that are each mounted under a corresponding rotor assembly.

Figure 4:
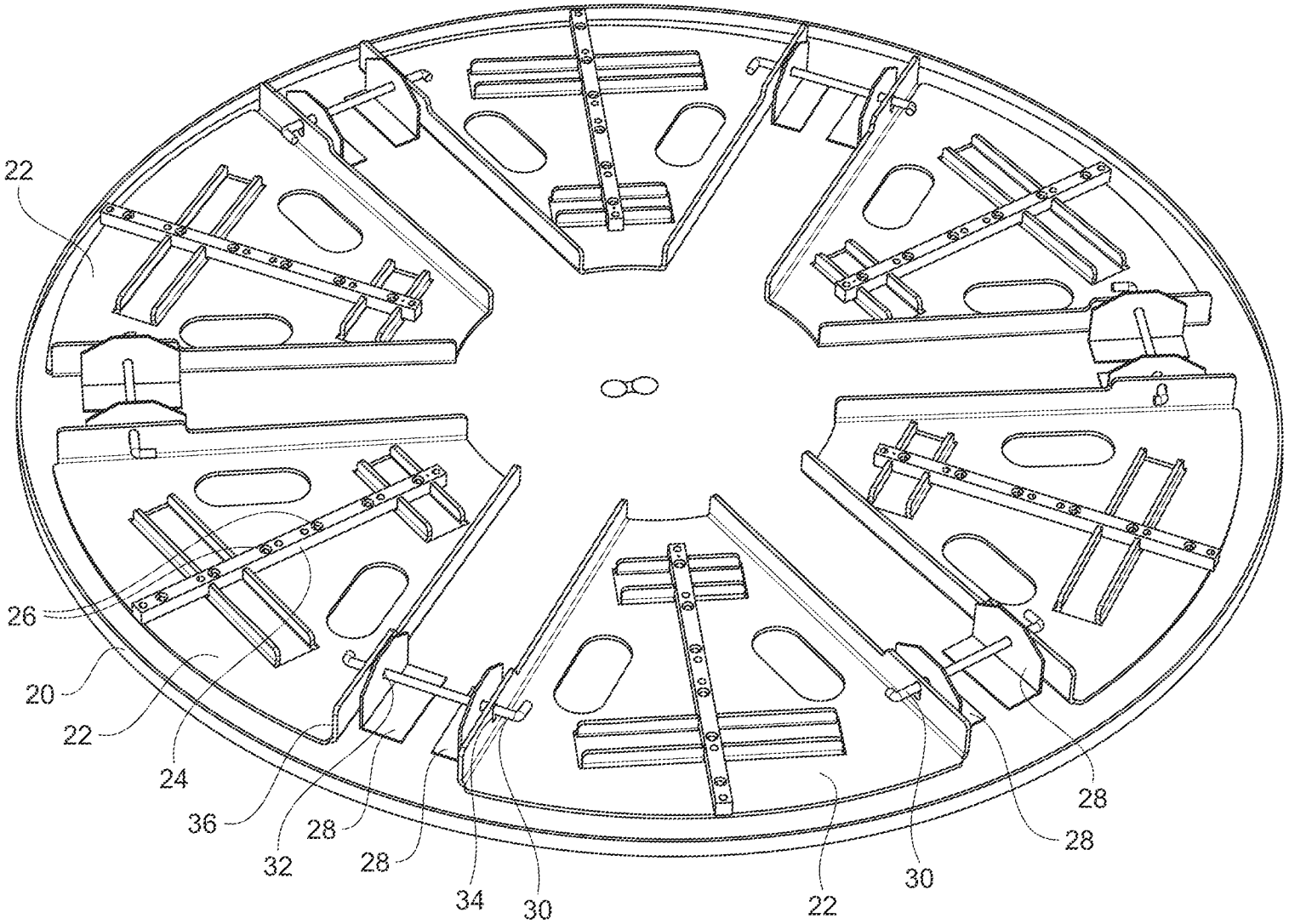
FIG. 4 is a top view of reinforcement assemblies installed on a pan of a troweling machine, in accordance with an illustrative embodiment of the present invention.

Referring now to FIG. 4, in addition to FIGS. 1 to 3, there is shown the underside of a pan 20 with six reinforcement members 22 removably connected thereto. Each reinforcement member 22 is preferably shaped as a flat truncated cone. Each reinforcement member 22 includes a central bar 24 extending in a radial direction with a series of threaded openings or screw holes 26 for receiving a bolt and allowing a connection to a corresponding troweling arm 14 of the troweling machine 10. Each central bar 24 is preferably soldered on its corresponding reinforcement member 22 for establishing a solid connection thereto, but it could be also removably connected or attached in other ways to achieve the same results. Each reinforcement member 22 is preferably removably connected to the pan 20 by means of a pair of brackets 28 and pins 30. Each bracket 28 is soldered near the outer edge of the pan 20 to establish a solid connection thereto, but it could also be removably connected or attached in other ways to achieve the same results. Each pin 30 is threaded through an aperture 32 on each bracket 28. Each pin 30 is also threaded through an aperture 34 on a raised portion 36 on the lateral edge of the reinforcement member 22.

In alternative embodiments, the reinforcement member 22 can be configured to be removably connectable to steel or plastic pans. In such embodiments, hook-and-loop fasteners (e.g. Velcro) can serve as a means of removably attaching the reinforcement member 22 to the steel or plastic pan, thereby rendering it unnecessary to put brackets on the pan that might weaken it.

Figure 5:
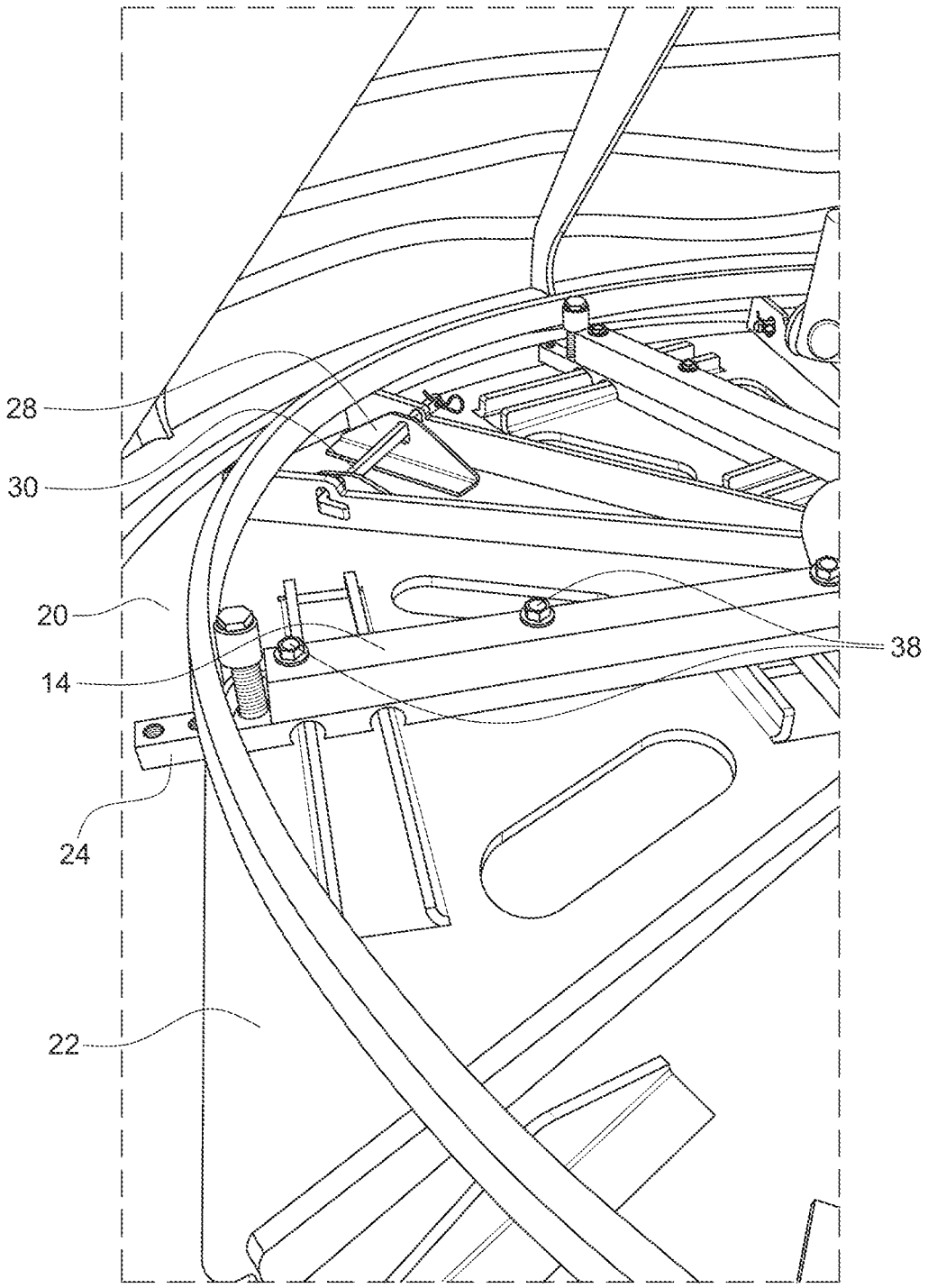
FIG. 5 is perspective partial view of reinforcement assemblies installed on a pan of a troweling machine, in accordance with an illustrative embodiment of the present invention.

Referring now to FIG. 5, in addition to FIGS. 1 to 4, there is shown the underside of the pan 20 with a reinforcement member 22 with a central bar 24 being removably connected to a troweling arm 14 of a troweling machine 10 via bolts 38.

Figure 6:
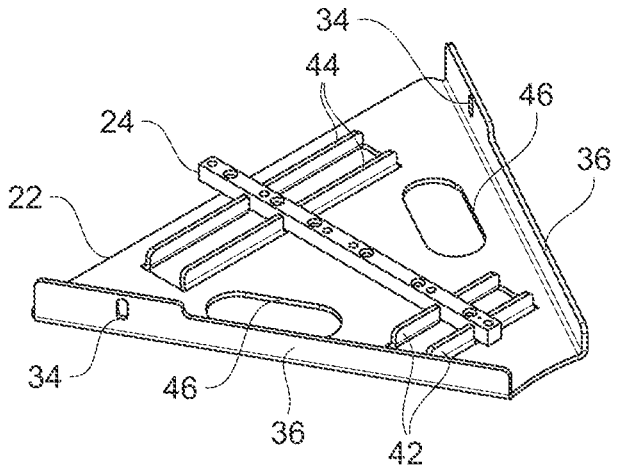
FIG. 6 is a perspective view of a reinforcement assembly, in accordance with an illustrative embodiment of the present invention.
Figure 7:
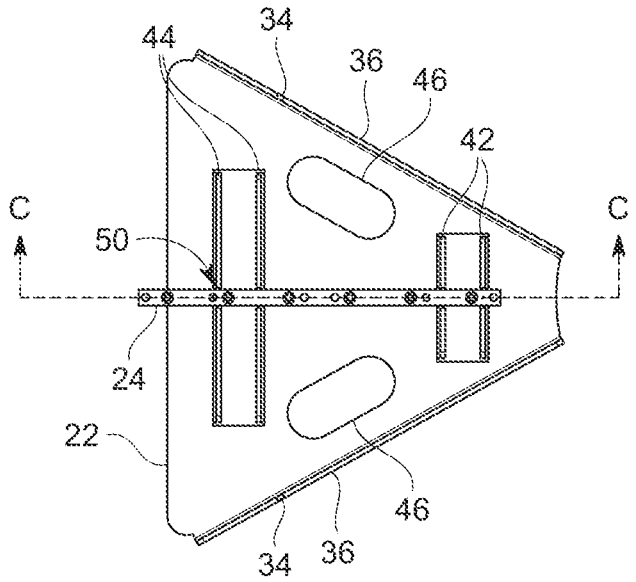
FIG. 7 is a top view of the reinforcement assembly shown in FIG. 6.
Figure 8:
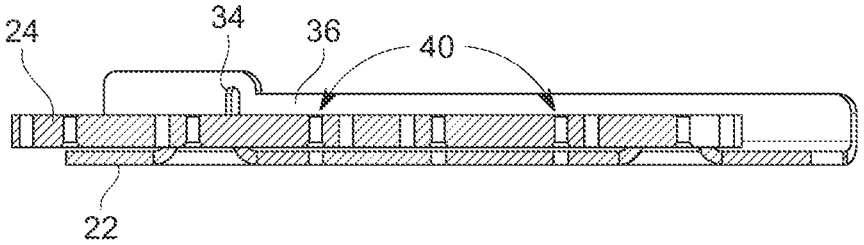
FIG. 8 is a side section view of the reinforcement assembly shown in FIG. 7 taken along line C-C.
Figure 9:
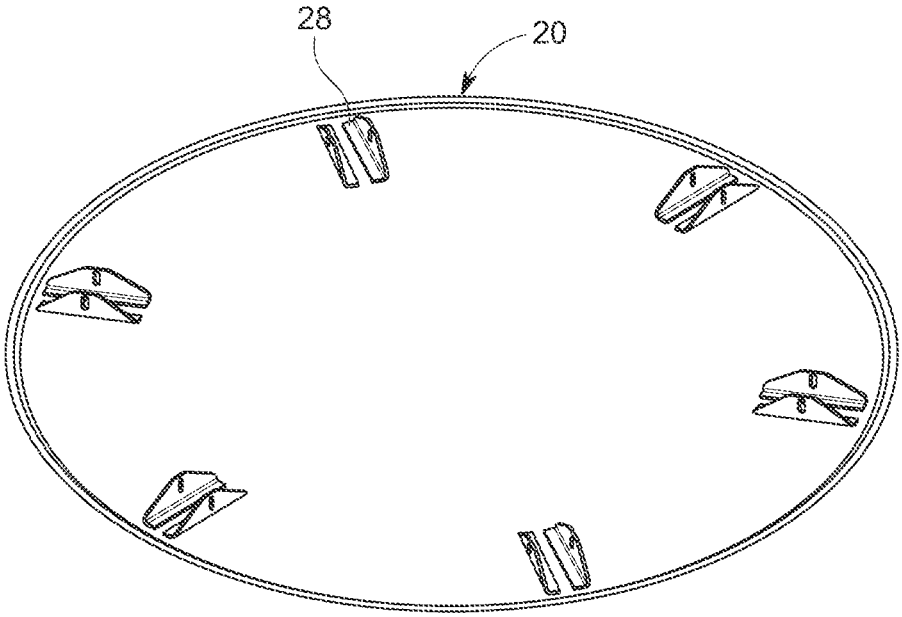
FIG. 9 is a perspective view of a pan with brackets, in accordance with an illustrative embodiment of the present invention.
Figure 10:
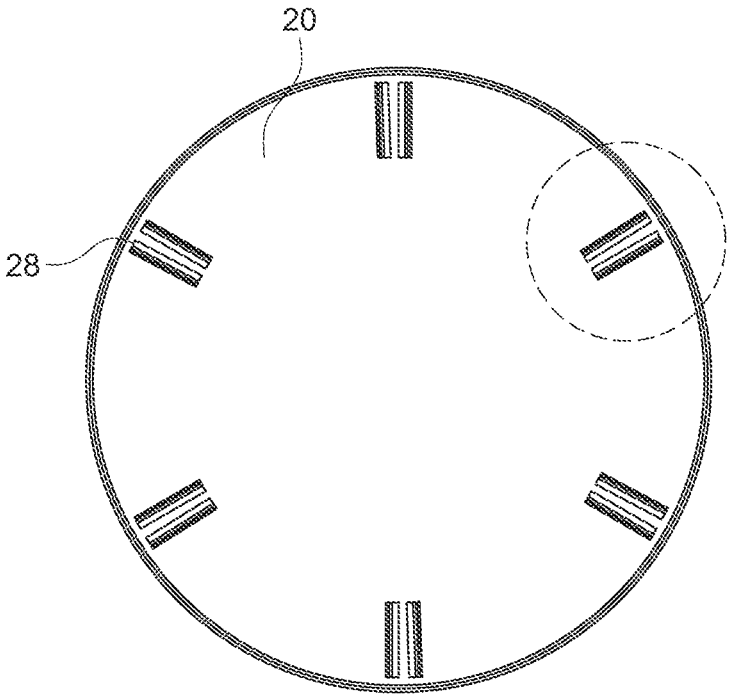
FIG. 10 is a top view of the pan shown in FIG. 9.
Figure 11:
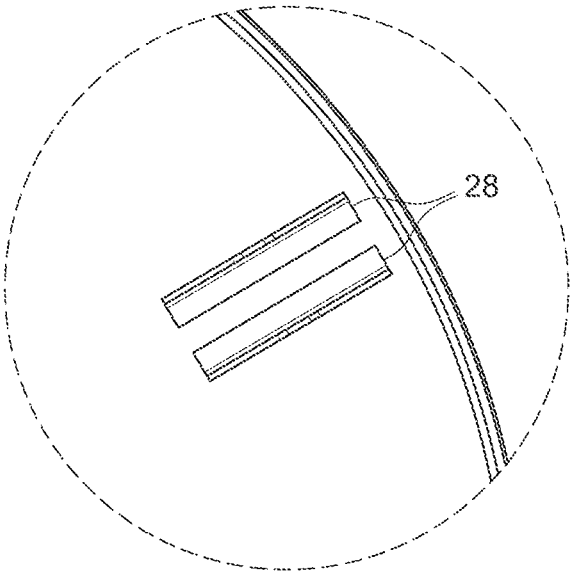
FIG. 11 is a detailed view of the pan shown at FIG. 10.
Figure 12:
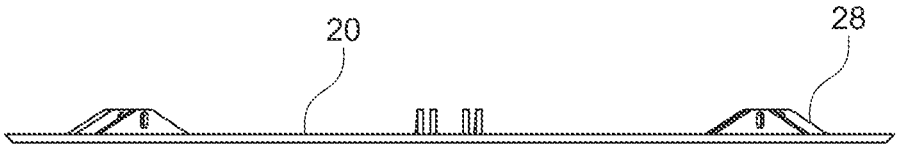
FIG. 12 is a side elevation view of the pan shown in FIG. 10.

Referring now to FIGS. 6 to 8, in addition to FIGS. 1 to 5, there is shown more detailed views of reinforcement member 22 with central bar 24 connected thereto by means of rivets 40.

The shape of the reinforcement member 22, such as a flat truncated cone, allows for a more uniform distribution of the forces throughout the surface of the pan 20 instead of being concentrated toward the center thereof, under the trowel. The shape of each reinforcement member 22 is configured to cover of the largest area of the pan 20. Each reinforcement member 22 may be made of a flat sheet of steel 3/16 inches thick. The sheet of steel is preferably bent (folded) on each side (preferably 1¼ to 1¾ inches at the largest) to strengthen the material by means of bends and to ensure that during operation of the pan 20 this minimizes distortion of the pan 20. The reinforcement member 22 may have four other bends 42, 44 inside of its shape. For example, the narrowest bends 42 may measure between 5 to 8 inches, depending on the model and may be located at 2.77 inches from the narrower end of the reinforcement member 22. The longest bends 44 may measure between 8 to 20 inches, dependant on the model, and may be located at 2.875 inches from the wider end of the reinforcement member 22. These bends 42, 44 help to distribute the weight of the trowelling machine 10 on a maximal surface area. Each reinforcement member 22 may be also be provided with an opening 46 on each side of the center bar 24, to help lighten the reinforcement member 22 and/or to make it easier to handle by operators.

In order to attach reinforcement member 22 to the trowelling machine 10, one may use the same trowelling mounting bar 24 as those used in the fabrication of the trowel blades 16 specified for the trowelling machine 10. However, to prevent having a slight fulcrum by welding the bar 24 directly on the reinforcement member 22, the bar 24 is may be joined or soldered onto portions of the bends 42, 44 in order to optimise the weight distribution on the pan 20.

In theory, to reach the same surface of a reinforcement member 22, one could enlarge a normal trowel blade 16, so that the point of contact would be wider. However, the typical shape of the trowel blades prevents them from covering all of the pan. There still would be a gap between the trowel blades, which would decrease the contact surface with the pan instead of maximizing it.

Referring to FIGS. 9 to 12, there is shown an embodiment of a pan 20 with brackets 28 that may be used with six reinforcement assemblies. The number of brackets and reinforcement assemblies, as well as their angular positions may vary as persons skilled in the art will understand.

Figure 13:
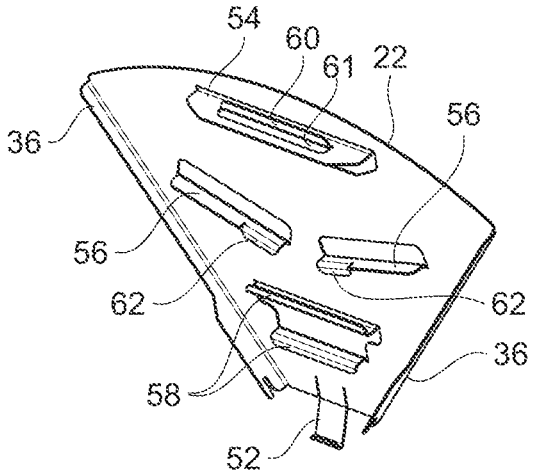
FIG. 13 is a perspective view of a reinforcement assembly, in accordance with another embodiment of the present invention.
Figure 14:
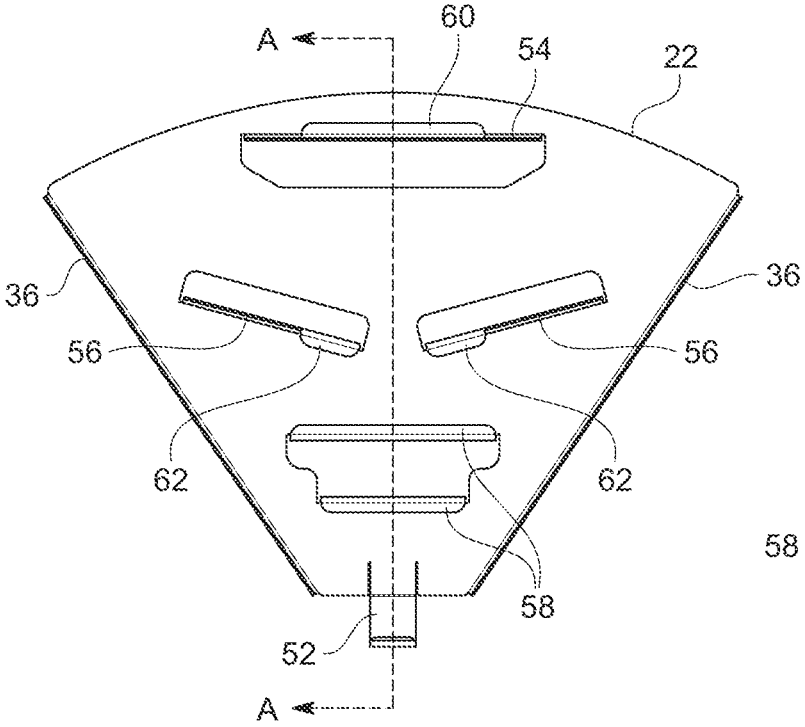
FIG. 14 is a top view of the reinforcement assembly shown in FIG. 13.
Figure 15:
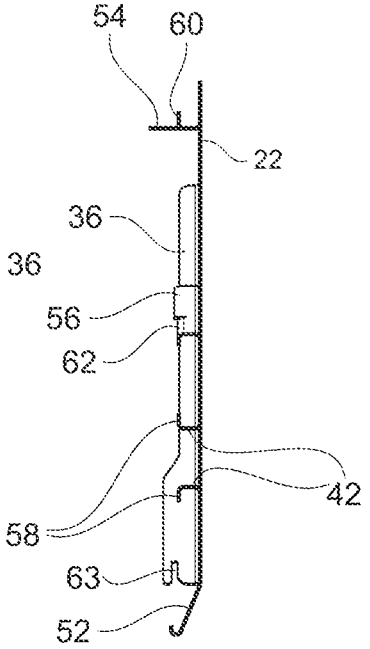
FIG. 15 is a side section view of the reinforcement assembly shown in FIG. 14 taken along line A-A.

Referring to FIGS. 13-15, there is shown another embodiment of the reinforcement assembly. In said embodiment, the reinforcement member 22 may have bends 42, 54, 56 inside of its shape. These bends 42, 54, 56 help to distribute the weight of the trowel blade on a maximal surface area. Also, the bends 42, 54, 56 can comprise flattened upper portions 58, 60, 62, which further help to distribute the weight of the trowelling blade on a maximal surface area. The reinforcement assembly can also comprise tab 52. In this embodiment, no central bar 24 is needed, as the reinforcement assembly 22 is slid on and secured to the trowel blades 16 using an aperture 61 defined by bend 54 and using tab 52. Tab 52 should be dimensioned to securely and removably hold the trowel blade in place, while also still being flexible enough to allow the trowel blade to be snapped into place and to be removed. Naturally, the aperture 61 defined by bend 54 should be large enough to securely receive an end of the trowel blades.

As can be seen in FIG. 15, the raised portion 36 can comprise a recessed portion 63 on a side thereof (the narrower end of the reinforcement member 22). This recessed portion 63 is dimensioned to receive a part of the trowel blade 16 when it is removably secured to the reinforcement member 22 using tab 52 and the aperture 61 defined by bend 54.

Figure 16:
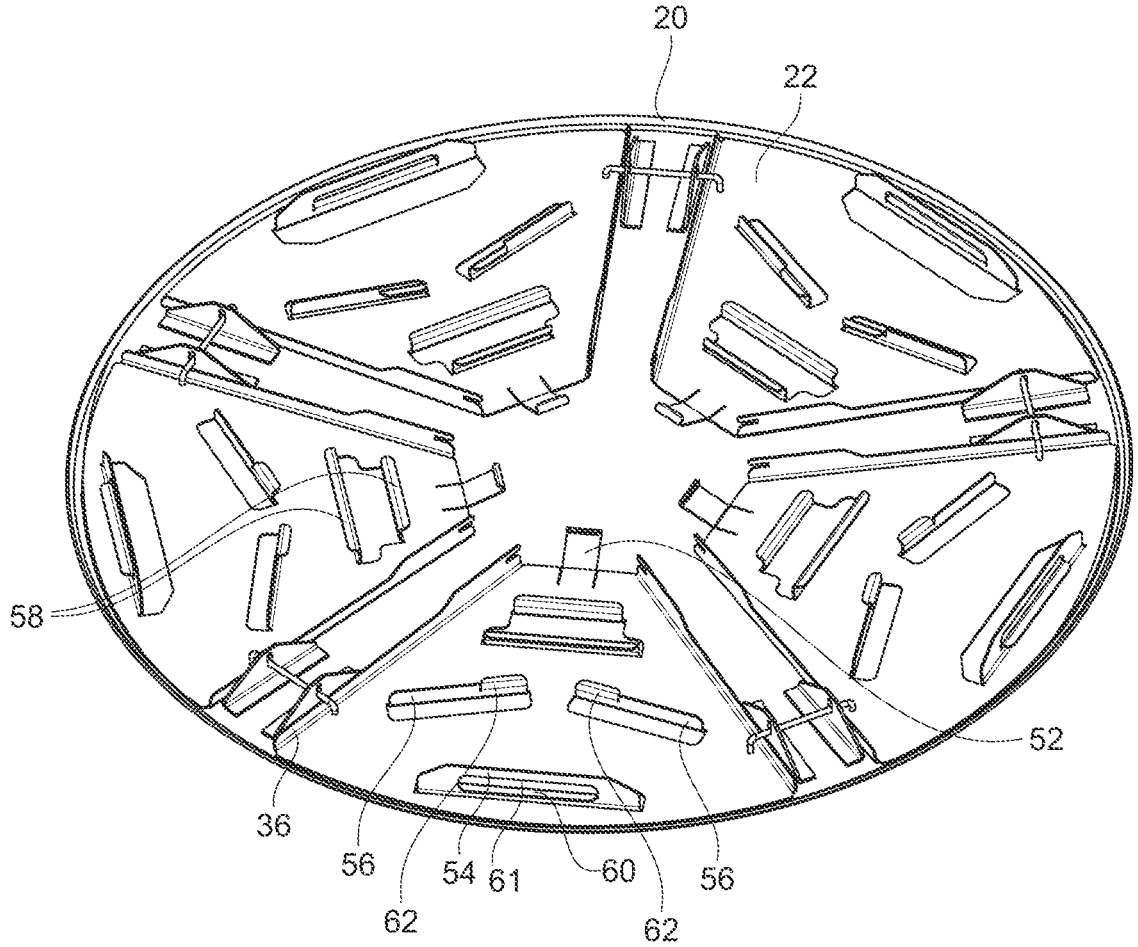
FIG. 16 is a perspective view of a pan with brackets comprising five of the reinforcement assembly shown in FIG. 13, in accordance with another embodiment of the present invention.

Referring to FIG. 16, there is shown an embodiment of a pan 20 with brackets 28 that may be used with five of the reinforcement assemblies shown FIG. 13. As with the embodiments shown in FIG. 6, each reinforcement assembly is preferably removably connected to the pan 20 by means of a pair of brackets 28 and pins 30. However, in the embodiment shown in FIG. 13, no aperture for receiving pins 30 is present on the reinforcement assembly. Rather, as shown in FIG. 16, by threading each pin 30 is through an aperture 32 on each bracket 28, each pin 30 can secure the reinforcement member 22 to the pan by securely abutting the upper surface of the raised portion 36 on the lateral edge of the reinforcement member 22.

As persons skilled in the art will understand, although five or six reinforcing assemblies have been illustrated in FIG. 4 or FIG. 16, the reinforcement assemblies may dimensioned such that said pan 20 can removably and operationally connect to two to height reinforcement assemblies simultaneously.

Figure 17:
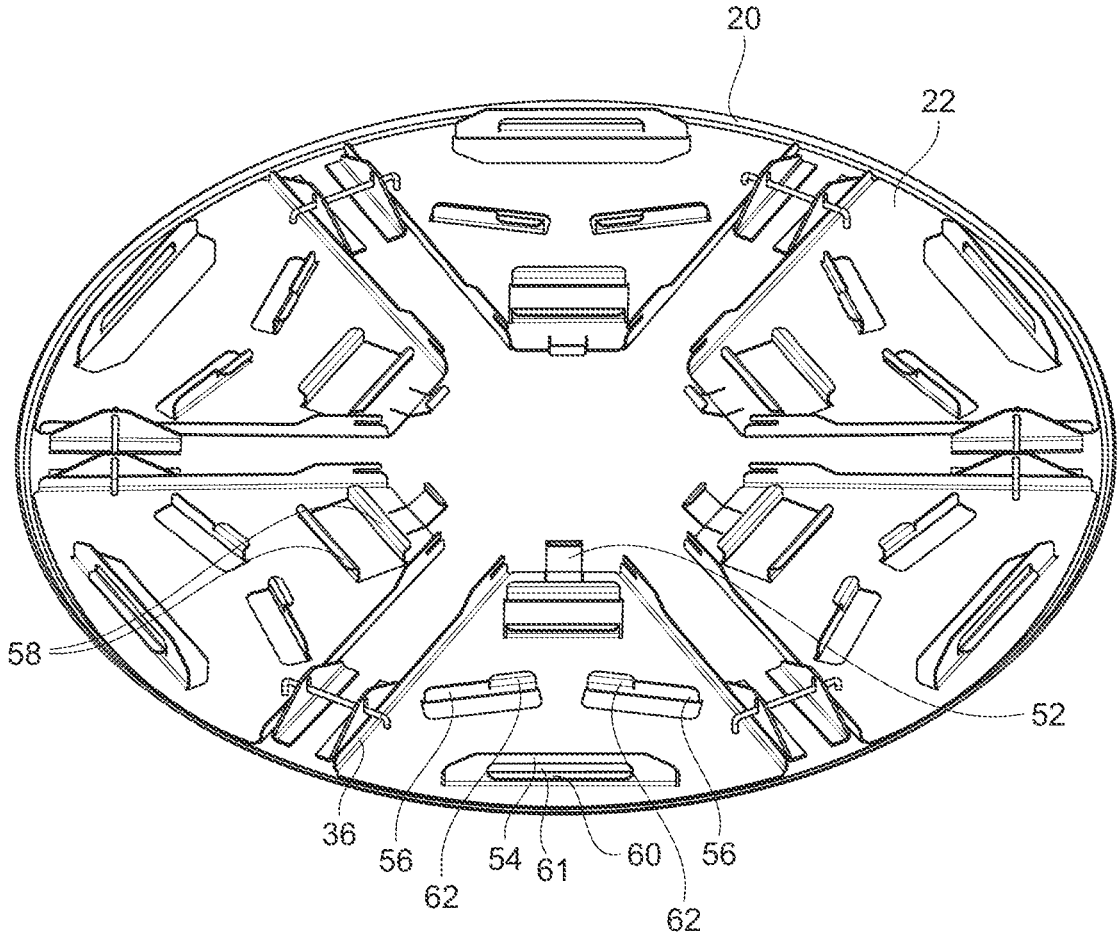
FIG. 17 is a perspective view of a pan with brackets comprising six of a narrower version of the reinforcement assembly shown in FIG. 13, in accordance with another embodiment of the present invention.

Referring to FIG. 17, there is shown an embodiment of a pan 20 with brackets 28 that may be used with six of a narrower version of the reinforcement assembly shown in FIG. 13. Specifically, the reinforcement assembly of FIG. 17 functions in the same manner as the reinforcement assembly shown in FIG. 16, except it is slightly narrower in design, such that a pan 20 can fit six of said reinforcement assembly, and not five as shown in FIG. 16. In preferred embodiments, the reinforcement assembly is dimensioned and the pan 20 is configured such that four, five, or six reinforcement assemblies can be removably connected to the pan 20, more preferably five or six.

Figure 18:
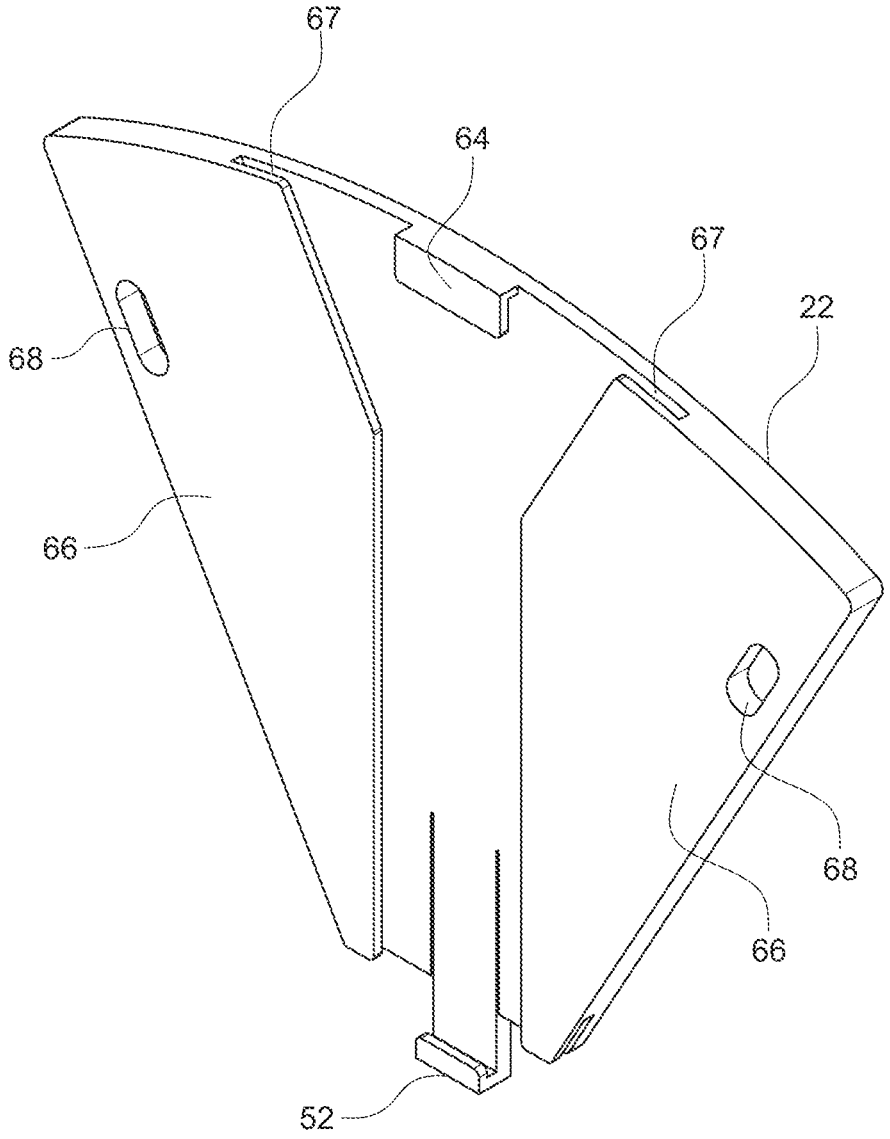
FIG. 18 is a perspective view of a reinforcement assembly, in accordance with another embodiment of the present invention.
Figure 19:
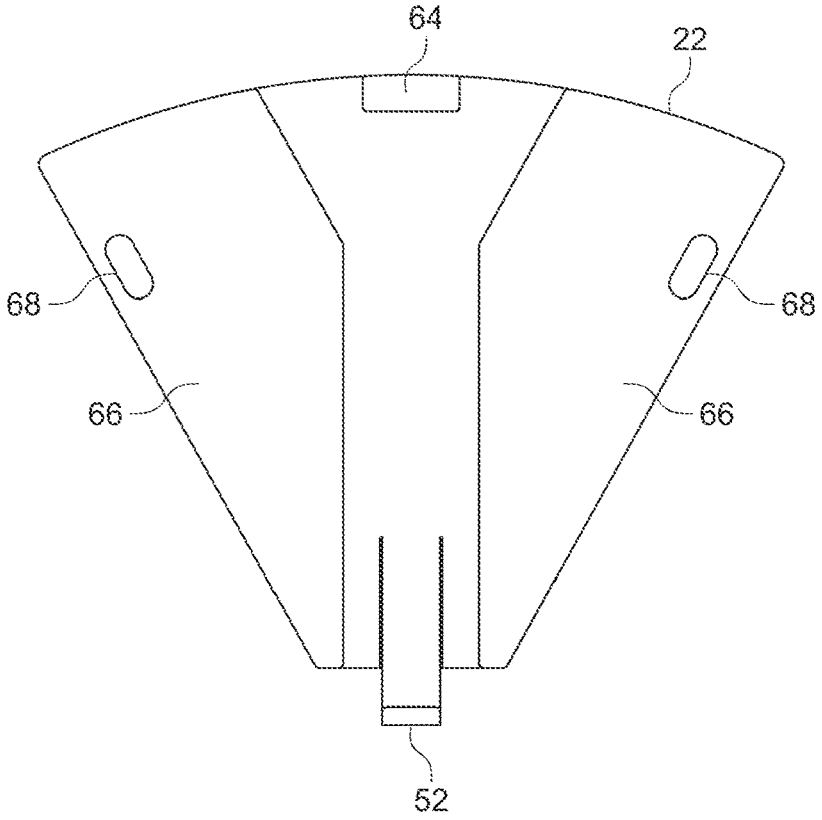
FIG. 19 is a top view of the reinforcement assembly shown in FIG. 18.
Figure 20:
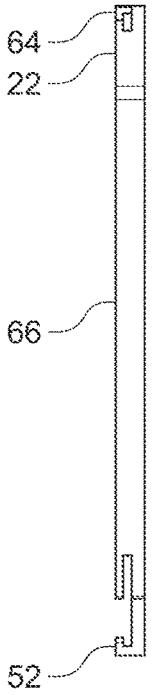
FIG. 20 is a side view of the reinforcement assembly shown in FIG. 19.

Referring to FIGS. 18-20, there is shown another embodiment of the reinforcement assembly. In said embodiment, the reinforcement assembly comprises tab 52, as well as tab 64. Upper portions 66 are dimensioned so as to define a cavity 67 that can slidably receive the trowel blade. In such an embodiment, the trowel blade can be slid through the cavity 67 starting from a side of the reinforcement assembly comprising tab 52 (located at the narrower end of the reinforcement member 22) and towards a side of the reinforcement assembly comprising tab 64 (located at the wider end of the reinforcement member 22). The cavity should also be dimensioned such that the trowel blade is secured once it is clicked into place with tabs 52 64 (e.g. dimensioned so as to prevent the trowel blade from sliding side-to-side).

Tab 52 can be designed in such a manner so that it will bend slightly while the trowel is slidably inserted into the reinforcement assembly. Once the trowel blade is received by tab 64, it can be clicked into place at tab 52. Tab 52 should be dimensioned to securely hold the trowel blade in place, while also still being flexible enough to allow the trowel blade to be snapped into place and to be removed. Naturally, as mentioned, the cavity 67 defined by the upper portions should be dimensioned so as to securely receive the trowel blade.

In the embodiment shown in FIGS. 18-20, apertures 68 are present so as to receive the ends of pins (not shown). Each pin can removably secure the reinforcement member 22 to a pan by securely abutting the upper portion 66 and by having aperture 68 receive the end of the pin. In preferred embodiments, the reinforcement member 22 shown in FIGS. 18-20 is made using a plastic, such as UHMW or UHMWPE (Ultra-high-molecular-weigh polyethylene), HDPE (High density polyethylene), Nylon, Acetal, Polyurethane, and other polymers, preferably UHMWPE.

In embodiments, the reinforcement member 22 is configured to have a suitable weight and rigidity that provides a greater flatness to the pan 20 than the typical trowel systems without such reinforcement member 22, because the resulting pan would not be as stiff or rigid.

In embodiments, in operation the movement of the pan 20 with the reinforcement assembly and the weight of the trowelling machine 10, affect the planeness of the pan 20 to reach its full potential which is preferably 80% flat.

In embodiments, the reinforcement member 22 is made of steel, but any other alloy that offers a sufficient firmness may be chosen. It is also possible to have the reinforcement member 22 be made of a hard and non bendable plastic for achieving similar results as with steel. The reinforcement member 22 is preferably intended to cover up to about 80% of the surface of the pan 20. It is possible to have reinforcement members 22 covering between 50% to 100% of the surface of the pan.

The scope of the claims should not be limited by the preferred embodiments set forth in the examples, but should be given the broadest interpretation consistent with the description as a whole.

The invention claimed is:

1. A reinforcement assembly removably connectable to a pan (20) of a troweling machine having a rotor assembly with corresponding troweling arms (14) each supporting a trowel blade (16), said reinforcement assembly comprising:

a reinforcement member (22);

a first connector operationally connectable to the reinforcement member (22), the first connector being removably and operationally connectable to one of the troweling arms (14) or one of the trowel blades (16); and a second connector operationally connectable to the reinforcement member (22), the second connector being removably and operationally connectable to the pan (20), wherein, in operation, the reinforcement assembly maximizes a distribution of weight of the troweling machine onto a surface of the pan (20).

2. The reinforcement assembly of claim 1, wherein the reinforcement member (22) comprises a plate shaped as a flat truncated cone.

3. The reinforcement assembly of claim 1, wherein the second connector comprises a pin (30) insertable in a bracket (28) connected to the pan (20).

4. The reinforcement assembly of claim 1, wherein the reinforcement assembly is dimensioned such that said pan (20) can removably and operationally connect to two to height reinforcement assemblies simultaneously.

5. The reinforcement assembly of claim 1, wherein the second connector comprises hook-and-loop fasteners, said hook-and-loop fasteners being removably connectable to corresponding hook-and-loop fasteners on said pan (20), and wherein said pan (20) is made of plastic.

6. The reinforcement assembly of claim 1, wherein the reinforcement member (22) has bends (42, 44) so as to distribute the weight of the troweling machine (10).

7. The reinforcement assembly of claim 1, wherein the reinforcement member (22) comprises at least one opening (46) to help lighten the reinforcement assembly and/or to make it easier to handle by operators.

8. The reinforcement assembly of claim 1, wherein the reinforcement member (22) is made of metal.

9. The reinforcement assembly of claim 1, wherein the reinforcement member (22) is made of a plastic.

10. The reinforcement assembly of claim 1, wherein the first connector includes a bar (24) provided with screw holes (26) corresponding to screw holes on the corresponding troweling arm (14).

11. The reinforcement assembly of claim 10, wherein the bar (24) is preferably joined or soldered onto portions (50) of bends (42, 44).

12. The reinforcement assembly of claim 1, wherein the first connector includes a tab (52) and a bend (54) defining an aperture (61) configured to removably secure one of said trowel blades (16) to the reinforcement assembly.

13. The reinforcement assembly of claim 12, wherein each side of the reinforcement member (22) comprises a raised portion (36) comprising a recessed portion (63) on a side thereof, the recessed portion (63) being dimensioned to removably receive a part of said trowel blade (16) upon being removably secured to the reinforcement assembly using the tab (52) and the aperture (61) defined by bend (54).

14. The reinforcement assembly of claim 1, wherein the first connector includes a first tab (52), a second tab (64), a cavity (67) defined by upper portions (66) and dimensioned to removably receive a trowel blade, the first connector being configured to removably secure one of said trowel blades (16) to the reinforcement assembly using the first tab (52), the second tab (54), and the cavity (67).

15. The reinforcement assembly of claim 14, configured to slidably receive the trowel blade through the cavity (67) in a direction from a side of the reinforcement assembly comprising the first tab (52) towards a side of the reinforcement assembly comprising the second tab (64).

16. A pan comprising brackets that is removably and operationally connectable to a plurality of reinforcement assemblies as defined in claim 1.

17. The pan of claim 16, dimensioned and configured to be removably and operationally connectable to two to eight of the reinforcement assemblies.

* * * * *